United States Patent [19]

Vicino

[11] 4,372,071

[45] Feb. 8, 1983

[54] FABRIC FACED BILLBOARD

[76] Inventor: Robert K. Vicino, 8847 Complex Dr., San Diego, Calif. 92123

[21] Appl. No.: 301,548

[22] Filed: Sep. 14, 1981

[51] Int. Cl.[3] ..... G09F 15/00

[52] U.S. Cl. ..... 40/624; 40/603

[58] Field of Search ..... 40/212, 213, 214, 624, 40/564, 603

[56] References Cited

U.S. PATENT DOCUMENTS

| | | | |
|---|---|---|---|
| 1,518,286 | 12/1924 | Wetzel | 40/212 |
| 3,346,978 | 10/1967 | Letsinger | 40/212 |
| 3,670,440 | 6/1972 | Yost | 40/215 |
| 3,977,111 | 8/1976 | Fritts | 40/564 |

FOREIGN PATENT DOCUMENTS

| | | | |
|---|---|---|---|
| 2050203 | 10/1970 | Fed. Rep. of Germany | 40/214 |
| 1478303 | 9/1977 | United Kingdom | 40/214 |

*Primary Examiner*—Gene Mancene
*Assistant Examiner*—Wenceslao J. Contreras
*Attorney, Agent, or Firm*—Charmasson, Branscomb & Holz

[57] ABSTRACT

An advertising billboard is provided and various methods and means of its construction are described and claimed utilizing the basic concept of drawing a sheet of fabric having the advertising message on the front across the rigid billboard panel and then introducing a continuous stream of air, or maintaining a continuous pressure, between the panel face and the fabric to smooth the fabric into a continuous, slightly curved surface without wrinkles or sag lines.

15 Claims, 5 Drawing Figures

FABRIC FACED BILLBOARD

BACKGROUND OF THE INVENTION

With the gross advertising budget of this nation being what it is, it is easy to believe that a tremendous amount of money and human energy goes into the production and maintenance of the billboard system across the country. The invention relates specifically to billboards.

There are two types of billboards in virtually universal use today. A smaller version, called the "poster" is ten feet high and twenty-four feet long, and may come with a metal frame. Typically, the poster is covered with several panels of paper which are glued to the billboard backing panel. Paper has the advantage that it is capable of mass production and printing processes, but suffers from a couple of major drawbacks. First, even when freshly printed, because the printing process utilizes ink, the resulting poster billboard tends to be dull and colorless compared to the bright, sharp colors available from a painting process. Secondly, the paper ordinarily weathers rather fast and begins fading and peeling. The ink on the poster ages more quickly than does paint.

The second industry standard is termed alternatively the "Bulletin", or the "Spectacular". In the event a complex pictoral is represented on the bulletin, printed paper may be used as on the poster. Ordinarily, however, plywood panels are used which are hand painted to produce a durable, clear, and very bright pictoral. From a visual standpoint, the painted plywood panels are much preferred to the paper. However, from a labor standpoint, these panels are very expensive, both from the production and the deployment standpoint.

In the case of most plywood billboards, artist's shops across the country are utilized to paint the billboards used in that particular locale. This is done, of course, because since there is no mass production technique that is really practical with the billboards anyway, and shipping costs are high, distribution of production to local centers is cheaper than central production. However, one drawback, which may not be major, is the lack of uniformity from one part of the country to the next between billboards and advertising presentations presented on them due to the diversity of artists.

In some occasional instances (for example, large Marlboro billboards which are oversized, being twenty feet tall and sixty feet wide) the plywood panels may be painted in one location by a particularly adept artist and shipped out on location. This is, of course, very expensive.

Regardless of how the plywood panels are made, once they are delivered to the hanging site, erection of the panels into place requires the use of a crane and ordinarily three men who work three to four hours on the project. This is particularly onerous costwise when it is considered that the panels must be moved and either reinstalled or painted over in a period of several weeks, requiring the same effort for the installation of another billboard.

One method that has been tried in order to avoid all or most of these problems has been the use of fabric stretched over the face of a billboard. Fabric has the advantage that it may be printed, painted, or silk-screened, it may be folded and is easy to ship like paper, it is lightweight, but it will take graphics as easily and as beautifully as does wood. An additional and most desirable feature stems from the fact that billboards of this type can be moved frequently from site to site, resulting in an increased exposure to the public.

Unfortunately, experience with fabric has shown that when stretched over the face of a billboard, under action of gravity, the fabric will wrinkle and stretch when exposed to the constant variations of temperature, humidity and precipitation of a billboard environment. For this reason, the use of fabric has been abandoned.

SUMMARY OF THE INVENTION

The instant invention, however, overcomes the problems previously inherent in the use of fabrics or synthetic sheet materials as facing for billboards. The inventor, having a great depth of experience in giant inflatable advertising media, and also being the inventor of Animated Three-Dimensional Inflatable Display having U.S. Pat. No. 4,271,620, has adapted inflatable technology to a billboard. In essence, the fabric which is imprinted or painted with the advertising message is stretched across a somewhat special billboard or a modified existing billboard, and a continuous-action blower operating through a hole in the back of the billboard applies a continual pressure to the back surface of the fabric insuring that it holds its shape in a smooth contour rather than wrinkling or sagging in the weather. Special features include the possibility of utilizing lights within the pocket or chamber defined between the billboard and the fabric, the use of a three-dimensional inflatable communicating with the air chamber, and special structure utilized to convert an existing billboard for use with the fabric so that it is still usable as a conventional billboard with plywood or paper.

DETAILED DESCRIPTION OF THE PREFERRED EMBODIMENT

Figure 1:
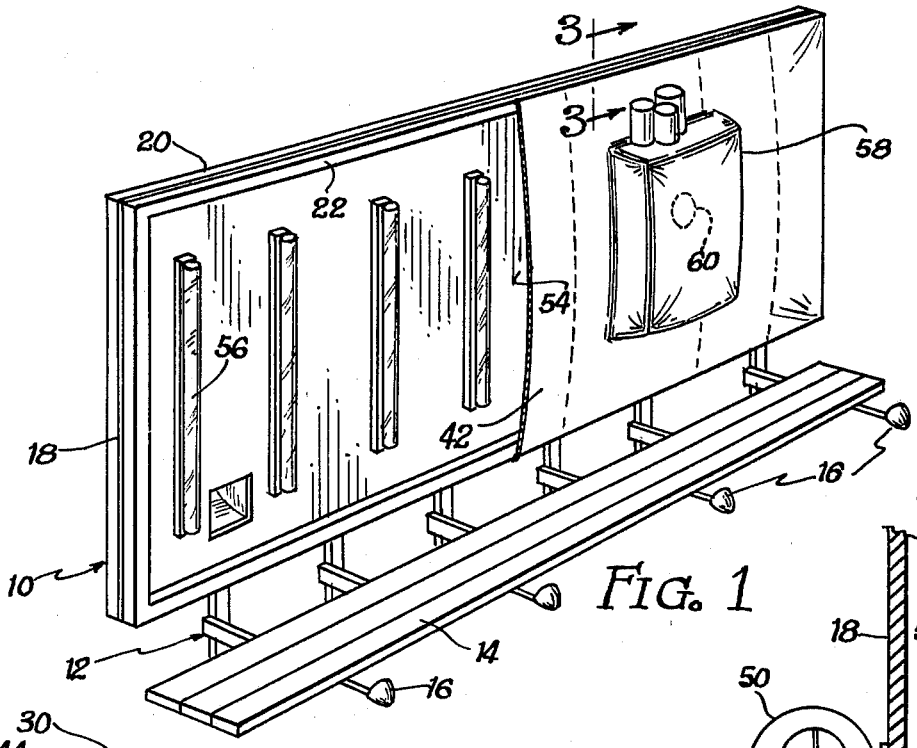
FIG. 1 is an isometric view of the billboard with portions of the fabric cut away.

The billboard is shown at 10 with its ground support frame 12, catwalk 14, and front lighting 16. An existing billboard has a flat backing panel 18 supported on the frame 12 and reinforced with a beam border 20 of two-by-fours around its rear periphery. Whatever plywood panels or paper panels are used according to conventional billboard techniques are, of course, applied against the front surface of the backing panel 18, and lit from the front with lighting 16.

There is virtually a limitless variety of systems that are conceivable to modify this existing billboard structure to accomodate the inflated fabric concept that is the heart of this invention. The one shown utilizes a front rib-like framing member 22 that extends around the entire periphery of the front face of the billboard parallel to the beam border 20 behind the billboard. This rib in the illustrated embodiment is made from two-by-two's fastened with nails 24 through the panel into the back beam border.

In a further modification to the existing structure, bores 26 are made at spaced intervals through the beams 20 and are secured in place with bolts 27 having counter sunk nuts 28 so that threaded studs 30 project outside the beam. The actual fabric-gripping element is a clamp bar 32 which is provided in four-foot lengths and engaged over the studs 30 through lateral slots 34 which have identical mutual spacing to that of the studs 30.

Figure 3:
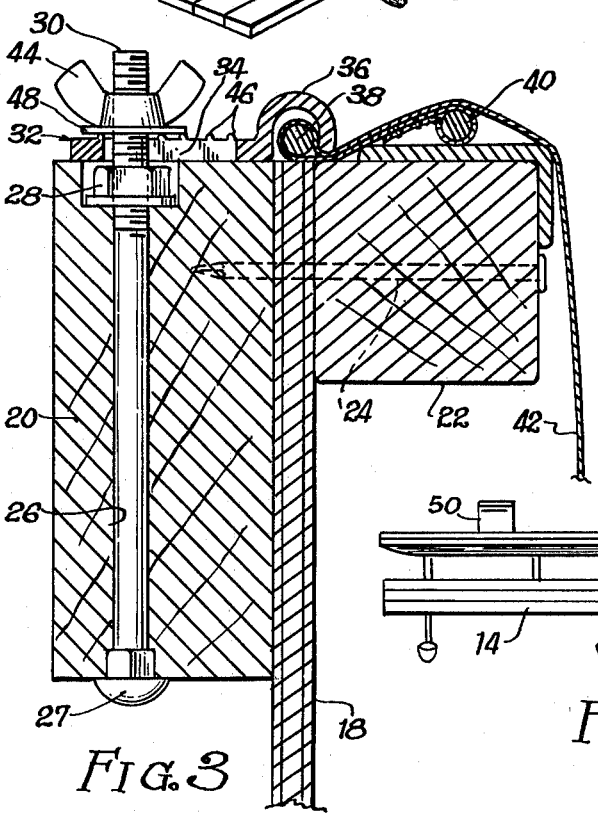
FIG. 3 is a section taken along line 3—3 of FIG. 1.

The forward portion of the clamp is a continuous cupped jaw 36 which engages a rope or continuous bead 38 enveloped in the perimeter of the fabric as shown in FIG. 3. A second rope 40 is permanently engaged at the very outer edge of the fabric sheet 42 to facilitate handling and positively prevent disengagement of any portion of the sheet from the clamp. The clamp jaw 36 continuously engages the rope 38 around its entire length of travel, with as many of the four foot clamp bar lengths 32 being used as are needed. Once the clamp bars are engaged over the ropes 38 and thus the sheets 42, they may be tightened by moving the clamp bars rearwardly before tightening down the wing nuts 44 which engages serrations 46 on the clamp bars through washers 48.

One person can hang the entire sheet in a relatively short period of time. The sheet, which can be either a woven or a non-woven tough synthetic, for a typically sized fourteen foot by forty-eight foot billboard weighs around forty pounds, and by providing an eyelet in each of the upper corners, a single worker can engage these eyelets on the respective studs 30 and then working from the center, clamp the sheet in, removing the eyelets from the studs when clamping down those portions of the sheet adjacent the eyelets. No crane is needed, nor are several men needed, the cost of whose time, of course, also includes transportation to and from the billboard site.

Figure 2:
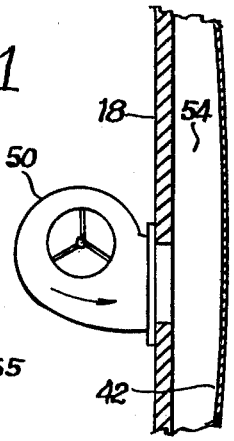
FIG. 2 is a side elevation view of the blowers mounted on the back of the billboard panels, the arrow showing direction of air.
Figure 4:
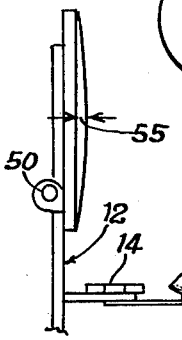
FIG. 4 is a somewhat diagrammatic side elevation view of the billboard seen from a distance illustrating the relative degree of billowing of the fabric.
Figure 5:
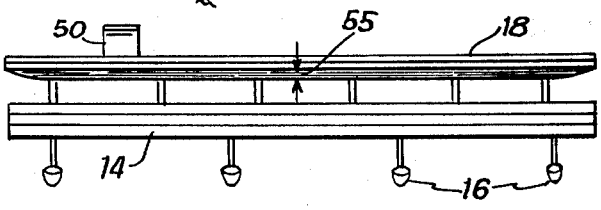
FIG. 5 is a top elevation view of the billboard.

As best seen in FIG. 2, a blower 50 is mounted to the back of the billboard panel by any suitable means so that its continuous operation maintains a pressure within the chamber 54 between the fabric and the billboard panel. This chamber is ideally no wider than about ten to twelve inches at the widest as indicated by arrows 55 in FIG. 4 in a billboard that is usually at least ten feet high, so that a substantially flat front fabric surface is maintained as shown in the drawings. Also disposed in this chamber may be mounted lighting means such as flourescent lights 56, which when used with translucent sheet material would provide a very attractive backlighting effect to supplant, or possibly even supplement, lighting from the fixtures 16. Another option would be the incorporation of a three-dimensional inflatable such as cigarette pack 58 which communicates through the opening 60 with the main chamber 54 so that it also is slightly pressurized to maintain its shape. This cigarette pack, of course, is shown as an example only, as there is no limit to the number or complexity of inflatable figures that can be mounted on the front of the sheet 42 and derive their pressurization from the chamber 54.

There are many means of implementing the general concept set forth herein of utilizing a fabric front for a billboard sign or other planar surface by pressurizing a chamber created between the existing billboard panel, or the equivalent, and the fabric. The front rib 22 could be eliminated, alternate clamp structure could be utilized, variations on blower mounting and positioning and lighting means could also be conceived which are intended to be within the scope of the appended claims, which, while claiming the specific features of the instant invention, both as it pertains to means and method of displaying advertising material and means and method of modifying an existing billboard, are not intended to be limited in their broadest sense to the specific implementations of the concept.

What is claimed is:

1. A display comprising:

(a) a flexible sheet defining a message-carrying surface;

(b) a support frame and means for mounting said sheet substantially continuously around its periphery to said frame;

(c) backing means comprising a rigid planar back board panel of a billboard behind said sheet and together with said sheet defining a substantially enclosed chamber;

(d) means for introducing air into said chamber on an ongoing basis at a pressure higher than ambient to billow said sheet away from said backing to tauten same so that said message-carrying surface is generally smooothly deployed and substantially free of surface discontinuities resulting from such effects as sagging, stretching and wind ripple; and (e) said support frame including means supporting said billboard upright over a ground surface.

2. Structure according to claim 1 wherein said means for mounting said sheet includes a peripheral forward rib framing member defined on said panel and means engaging said sheet around said rib spaced from the front surface of said backboard.

3. Structure according to claim 1 and including lighting means mounted to said panel in the space defined behind said sheet.

4. Structure according to claim 3 wherein said lighting means comprises a plurality of upright flourescent tubes.

5. Structure according to claim 1 and including a trim cord wrapped in the periphery of said sheet and said means engaging said sheet engages same by said trim cord.

6. Structure according to claim 5 wherein said means engaging said sheet comprises a series of clamp plates bolted to said frame on projecting threaded studs.

7. Structure according to claim 6 and including a peripheral forward rib framing member defined on said panel and said clamp plates span lengths of said rib framing member of on the order of four feet and define lateral slots to engage said studs to effect tension adjustment of said sheet.

8. Structure according to claim 1 wherein said flexible sheet includes a two-dimensional planar flexible sheet base member and at least one three-dimensional inflatable mounted to the front thereof and communicating with said chamber such that said inflatable is substantially free of said panel and supported by said base member.

9. A method of converting a conventional billboard having an upright panel mounted on a frame into a billboard having a smooth fabric front, comprising the following steps:

(a) fastening a rib structural member as a forward border around the front periphery of said panel and drawing said sheet around said rib;

(b) stretching a sheet with a message on the front thereof around the front of said panel;

(c) retaining said sheet to the edges of said panel in generally airtight fashion to define a pocket between said panel and said sheet;

(d) continuously introducing air into said pocket to tauten said sheet and eliminate discontinuities from the front surface thereof.

10. Structure according to claim 9 wherein said billboard defines a rear beam border around the periphery of said panel and step (b) comprises attaching clamps to said beam border and clamping the periphery of said sheet therewith.

11. Structure according to claim 10 wherein the attaching of said clamps comprises passing a series of bolts out through said beam border with the threaded ends thereof extending as studs, and said clamps are engaged thereon through slots in said clamps engaged on said studs and retained by nuts.

12. Apparatus for adapting a billboard having a planar display panel and a rear peripheral support beam for use as a smooth, surfaced flexible sheet display, comprising:

(a) a flexible sheet having a message on the front surface thereof;

(b) means for attaching said sheet around the edge of said billboard;

(c) a blower, and means for mounting said blower to said panel at a hole cut therein to continuously blow ambient air between said panel and said sheet.

13. Apparatus according to claim 12 and including a plurality of elongated members and means to fasten same to the forward face of the border of said panel to support said sheet.

14. Apparatus according to claim 12 and including a plurality of bolts to pass through said beam border to secure said means for attaching thereto.

15. Apparatus according to claim 14 wherein said means for attaching comprises a plurality of elongated clamps to clamp the periphery of said sheet, and lateral slots defined in said clamps for engaging over said bolts and nuts to secure said clamps to said bolts.

* * * * *